US005319813A

United States Patent [19]

DiMatteo et al.

[11] Patent Number: 5,319,813

[45] Date of Patent: * Jun. 14, 1994

[54] INVALID TRANSFER ARRANGEMENT

[75] Inventors: Paul DiMatteo, Dix Hills; Charles Chubb, Brookville, both of N.Y.

[73] Assignee: Nova Technologies, Inc., Hauppauge, N.Y.

[ * ] Notice: The portion of the term of this patent subsequent to Jul. 7, 2009 has been disclaimed.

[21] Appl. No.: 908,988

[22] Filed: Jul. 6, 1992

Related U.S. Application Data

[63] Continuation of Ser. No. 713,139, Jun. 10, 1991, Pat. No. 5,127,113.

[51] Int. Cl.[5] ..... A61G 5/00; A61G 7/00

[52] U.S. Cl. ..... 5/81.1; 5/83.1

[58] Field of Search ..... 5/81.1, 83.1, 84.1, 5/88.1, 89.1; 280/250.1

[56] References Cited

U.S. PATENT DOCUMENTS

| | | | |
|---|---|---|---|
| 378,220 | 2/1888 | Staples et al. | 5/81.1 |
| 3,810,263 | 5/1974 | Taylor et al. | 5/81.1 |
| 4,054,959 | 10/1977 | DiMatteo et al. | 5/81.1 |
| 4,726,082 | 2/1988 | DiMatteo et al. | 5/81.1 |
| 4,787,104 | 11/1988 | Grantham | 5/618 X |
| 4,819,283 | 4/1989 | DiMatteo et al. | 5/81.1 |
| 5,127,113 | 7/1992 | DiMatteo et al. | 5/81.1 |

FOREIGN PATENT DOCUMENTS

| | | | |
|---|---|---|---|
| 0172296 | 2/1986 | European Pat. Off. | 5/81.1 |

*Primary Examiner*—Michael F. Trettel
*Attorney, Agent, or Firm*—Max Fogiel

[57] ABSTRACT

An arrangement of a wheelchair with a movable seat and leg rest and a bed equipped with transfer apparatus including rollers, a movable sheet, a lift member, and a control system for transporting an invalid comfortably across the bed to a sitting position on the wheelchair.

8 Claims, 10 Drawing Sheets

INVALID TRANSFER ARRANGEMENT

This is a continuation, of application Ser. No. 713,139 filed Jun. 10, 1991 now U.S. Pat. No. 5,127,113.

BACKGROUND OF THE INVENTION

The process of transferring an invalid person from a bed to a wheelchair or commode often requires the help of two or more assistants. The task frequently requires considerable strength and is a common source of injury to the person being transferred or to the nurse (s) or attendant (s) doing the transfer. These problems often are the major factors that require a patient to be hospitalized or moved to a nursing home, rather than being cared for at home. They also increase the cost of caring for persons in hospitals and nursing homes.

SUMMARY OF THE INVENTION

The parent application describes an arrangement for transferring an invalid person from a bed to a separate horizontal surface by means of a sheet which is pulled over the mattress by being rolled up on a roller at the foot of the bed and unrolled from a roller at the head of the bed. Accordingly, it is the primary object of the present invention to provide a special wheelchair, which may be a commode or may be convertible to a commode, and a bed equipped with rollers, a transport sheet, and a lifting mechanism, so that a person can be comfortably transported over the bed and partially onto the horizontal seat of the wheelchair and then raised to a normal sitting position thereon, with no effort on the part of the invalid person and requiring minimal physical strength or skill on the part of an attendant.

In many cases invalid persons can easily be injured when they are being transferred between a bed and a wheelchair, due to such causes as stresses placed on weak bones or decubitus ulcers, or as a result of accidental falling. Accordingly, it is another object of this invention to provide a comfortable and safe method of transfer with minimum stress on the person's body and minimum sliding action which could cause or aggravate decubitus ulcers.

A further object is to pull a semi-reclining person who has slid down in the bed up to a comfortable position. This is a frequent and stressful task for nurses and attendants.

Additional objects and advantages of the present invention will become evident from the following description of specific embodiments when read in connection with the accompanying drawings.

Reference is made to a previous U.S. Pat. No., 4,819,283, application 937,015 which had the above objectives. This present application shows improved arrangements which can increase the comfort and safety of the transfer and simplify the operation of the equipment. In particular it shows an arrangement, which provides improved support of the patient during transfer from the wheelchair to the bed, improved adaptive control of the wheelchair transfer operation using a foot pressure sensor in the wheelchair foot rest and an integrated control system which provides manual or automatic operation.

It is to be understood that the term wheelchair, used herein, includes commodes.

This present invention is also applicable to transfer onto fixed chairs and seating, such as toilets, and there is no intent to limit the present invention to transfer between a bed and a wheelchair.

BRIEF DESCRIPTION OF THE DRAWINGS

FIGS. 1*a* through 1*h* are schematic sequential views showing the transfer of a person between a wheelchair and a bed;

DESCRIPTION OF THE PREFERRED EMBODIMENTS

Figure 1A:
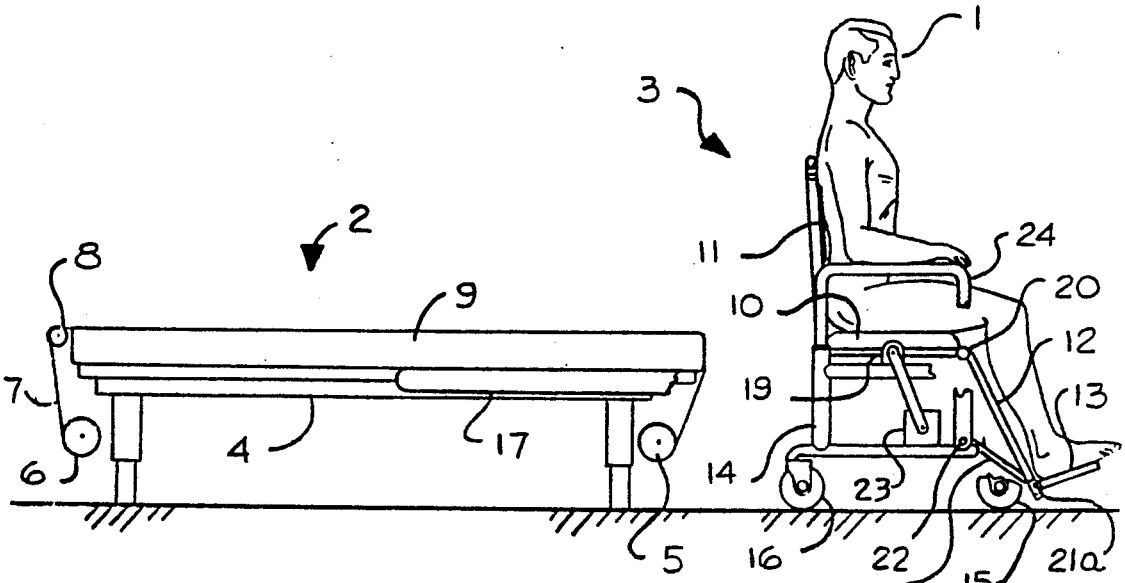

FIGS. 1*a* through 1*h* illustrate schematically the method used to transport a person from a wheelchair to a bed, FIG. 1*a* shows the person 1 seated in a wheelchair 3 ready to be transferred to bed 2. Bed 2 consists of a conventional bed 4, as found in a home or institution such as a nursing home or hospital, with modifications to be described. The bed is presumed to be-adjusted by conventional means (not shown) to the proper height to perform the required operations.

Attached to the bed 4 is an arrangement for transporting a person longitudinally across the bed. This arrangement contains a front roller 5 whose length is approximately equal to the width of the bed, and which is mounted at the foot-end of the bed. A similar rear roller 6 is positioned at the head-end of the bed. (Head and foot are seen from the patient's point of view.) A transport sheet 7, approximately equal in width to the width of the bed and significantly longer than the bed, is fastened to and partially rolled up on the front roller 5 while the other end is fastened to and partially rolled up on the rear roller 6 at the head-end of the bed. The transport sheet 7 passes over a supporting idler roller 8 between the mattress 9 and rear roller 6.

Electric motors or hand cranks provide mechanical power for driving the two rollers 5 and 6 to wind up the transport sheet 7 on one roller while allowing it to unwind from the other so as to move the sheet, and to thereby transport a person reclining thereon, across the surface of the mattress.

This particular arrangement of rollers is shown to help illustrate the principles of this invention, but the invention is not limited to this configuration, and other arrangements for moving a sheet across a bed to transport a person over the bed can be used equally well.

Also attached to the bed 4, by means not shown, is a lift member 17, which is described subsequently.

The wheelchair 3 contains a frame 14 supported on front wheels 15 and rear wheels 16, all of which are depicted as small in size. Either pair may be on casters or fixed axles, or the front pair may be large with fixed axles with the other pair on casters. The wheelchair back rest 11, is removably mounted as described subsequently. The seat 10 is rotatably mounted on each side to the frame 14, through seat pivots 19 and is connected to the top of the leg rest 12 through a knee hinge 20. The bottom of leg rest 12 is similarly attached on each side to links 21 through foot pivots 21*a*, and the other ends of links 21 are attached to frame 14 by link pivots 22. An electric motor 23 is coupled to this four-bar linkage at a seat pivot 19, or alternatively at a link pivot 22. The seat 10 is held securely in the normal seating position shown, by a gear train in the electric motor 23 except during transfer operation. A foot rest 13, attached to the leg rest 12, contains a foot pressure sensor which is described subsequently. Optional arm rests 24 are movably attached to frame 14.

Figure 1B:
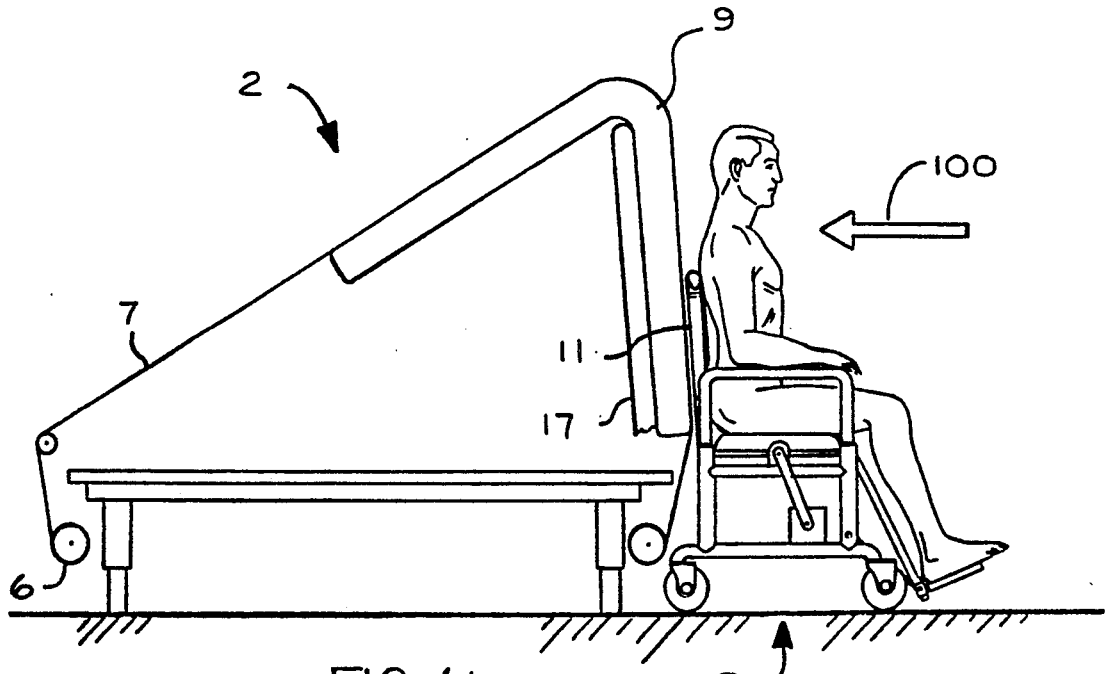

FIG. 1*b* shows the initial transfer steps. The wheelchair 3 has been pushed back, as shown by arrow 100, and latched (by means not shown) to the end of bed 2. The controls have been set for control by a transfer pendant as described subsequently and the pendant switch for transferring a person to the bed has been actuated. If a signal from the foot pressure sensor satisfies a logic safety check in the system controller that the person being transferred is sitting in the chair, rather than being on the bed, the lift member 17 will have been rotated to lift up the mattress 9 to approximately 85 degrees, as shown, with the sheet unrolled as needed from head-end roller 6. With the mattress raised and the wheelchair latched in position, the backrest 11 is unlocked (by means not shown) and is then removable. Alternatively, the lift member 17 may be configured to raise the transport sheet 7 instead of raising the mattress as shown in FIGS. 1*b*, 1*c*, and 1*d*.

Figure 1C:
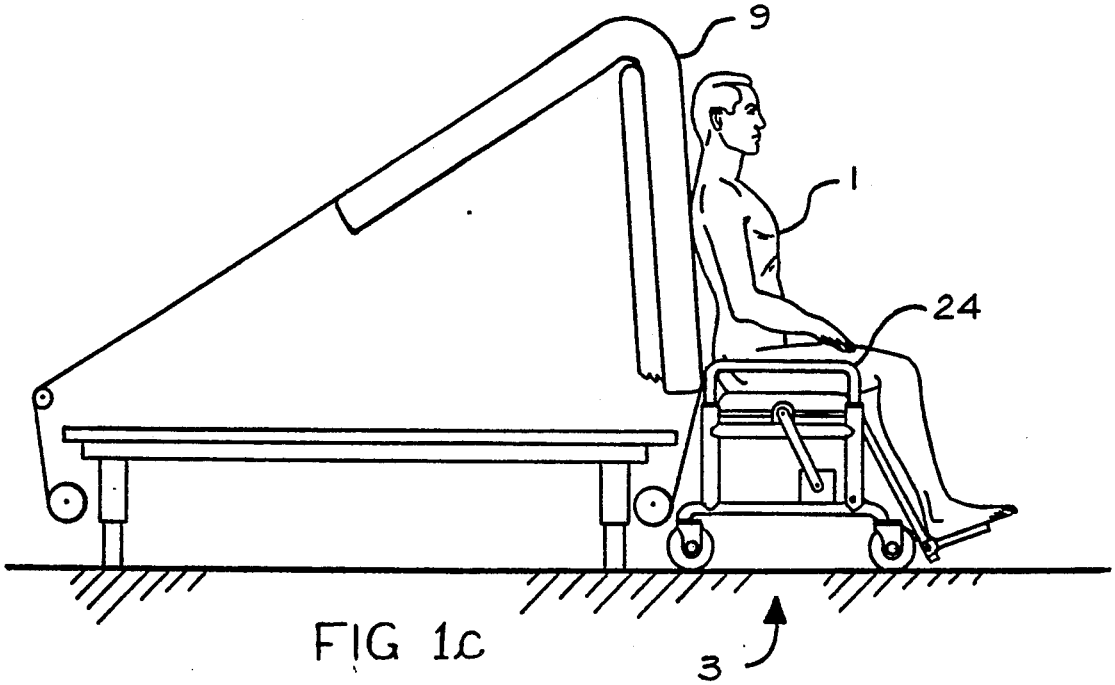

FIG. 1*c* shows the chair 3 with the back rest 11 removed so that the person 1 is resting directly against the mattress 9. The back rest 11 may be completely removed, as shown, or may be lowered, pivoted to the side, or otherwise taken out from behind the person's back. Arm rests 24 optionally may be moved down as shown or otherwise moved away from obstructing the transfer of the person 1.

Figure 1D:
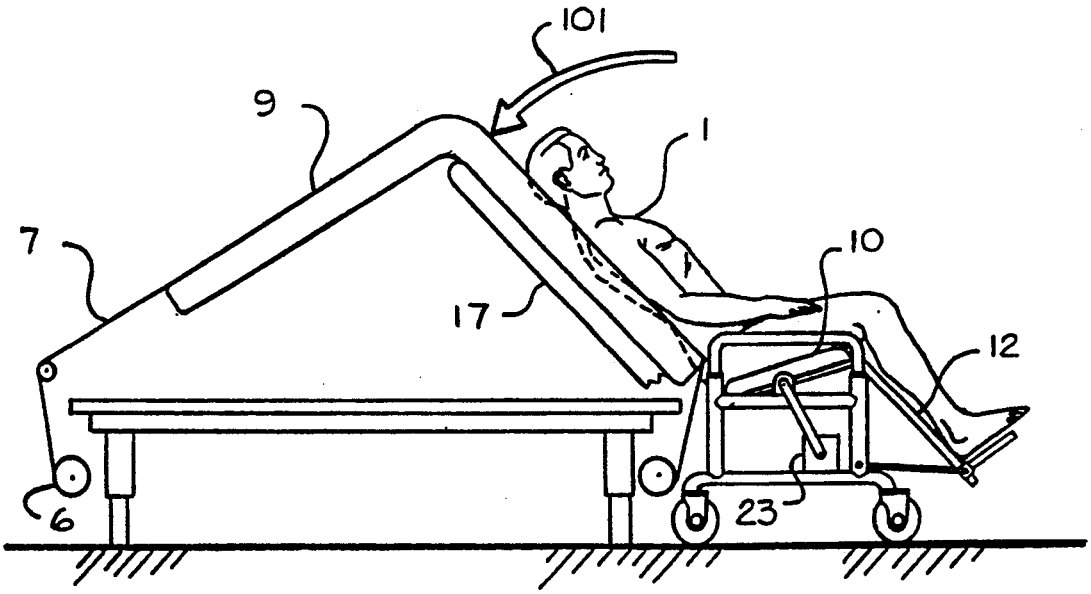

FIG. 1*d* shows the beginning of the actual transfer of the patient by the action of lowering the mattress lift member 17 which lower the person 1 toward a reclining position as shown by arrow 101. As the mattress is lowered, the motor 23 is energized to rotate the seat 10 approximately 20 degrees and raise the leg-rest 12. As mattress 9 moves down, the rear roller 6 is driven to take up slack in the transport sheet 7.

Figure 1E:
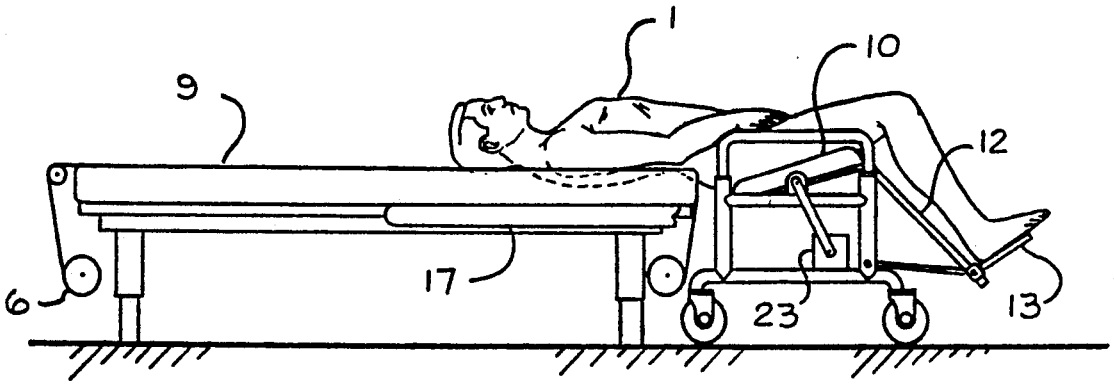

FIG. 1*e* shows the mattress lift member 17 in its lowered position with the person 1 reclining, partly on the mattress 9. When the mattress drops below approximately 20 degrees tilt, the sheet 9 starts moving as it is wound on roller 6 and motor 23 is energized again to rotate the seat 10 and raise the leg rest 12 and foot rest 13 to move the patient 1 onto the bed.

Figure 1F:
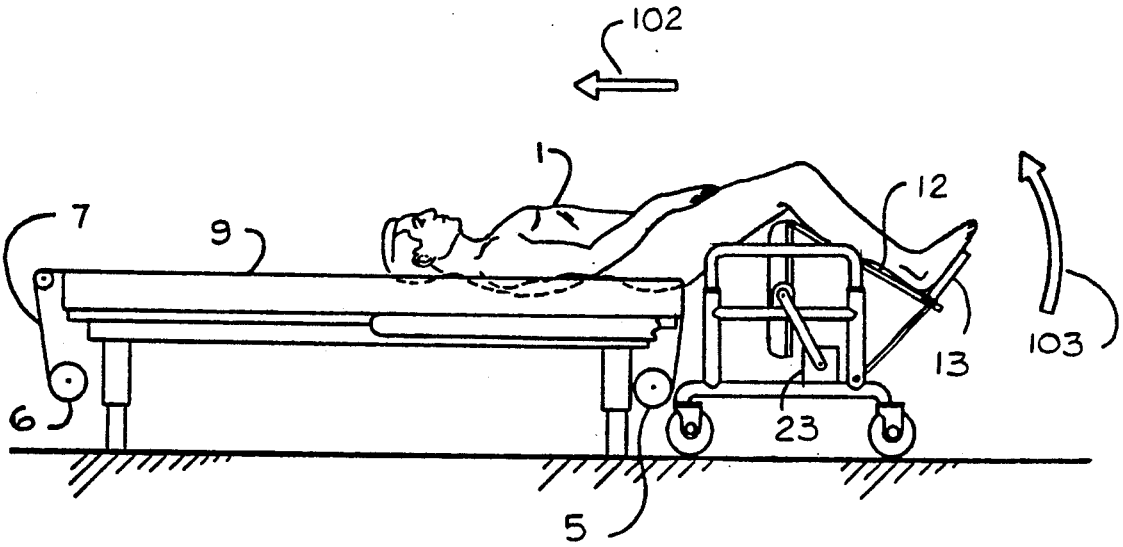
Figure 19:
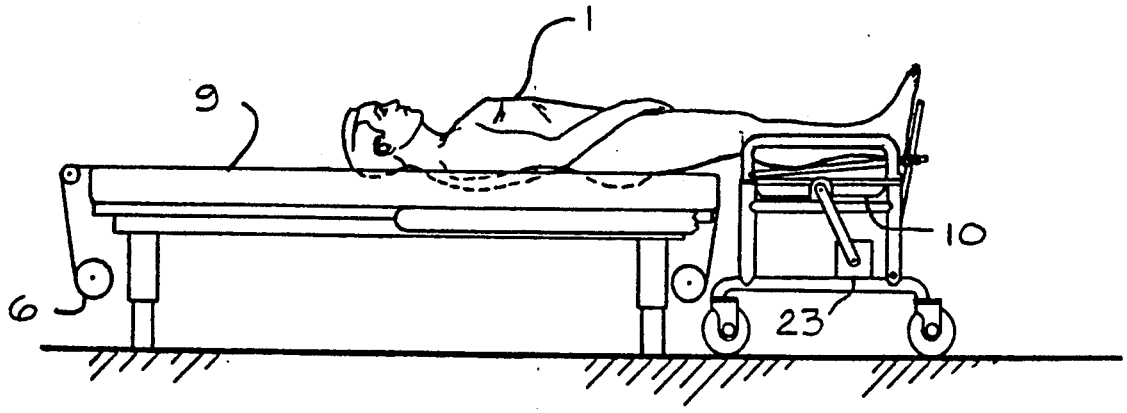

FIG. 1*f* shows, by arrows 102 and 103, the action of the sheet 7 in pulling the person 1 onto mattress 9 as rear roller 6 is driven to wind up sheet 7, drawing it across the mattress 9 from front roller 5. At this point in the transfer the motor 23 is energized only when the pressure sensor in the foot rest 13 has detected foot pressure, so that the leg rest 12 is driven adaptively to follow, rather than push, the person's feet as he is pulled fully on the mattress by the sheet. The foot pressure sensor is described subsequently.

Figure 1H:
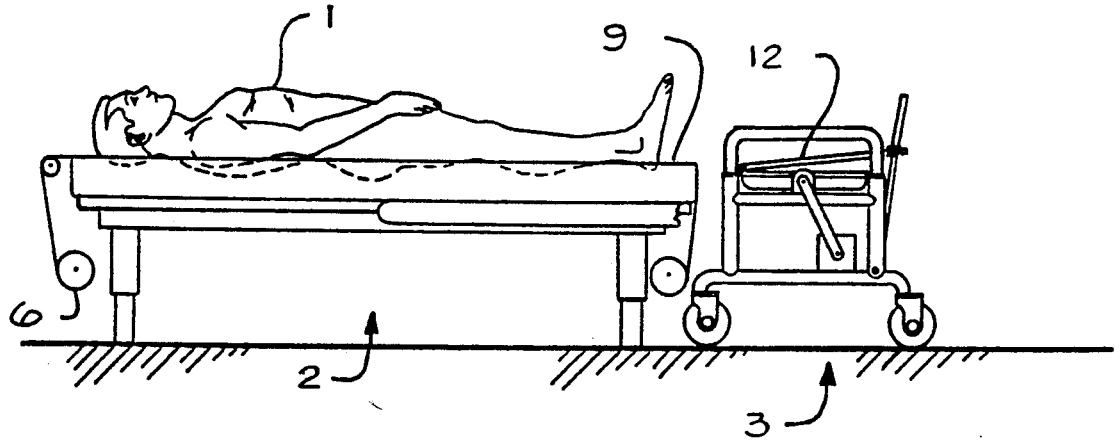

FIG. 1*g* shows seat 10 has been completely rotated to 180 degrees at which time the motor 23 is stopped Rear roller 6 continues to move the person 1 until he reaches the middle of the mattress 9, as shown in FIG. 1*h*. His feet and legs slide across the leg rest 12, which is soft and covered with a smooth slippery material such as nylon, to prevent skin irritation. The wheelchair 3 can then be unlatched and removed from the bed 2, if desired.

By reversing the directions of motion and the order of the above steps, the patient can be transferred back from the bed to the wheelchair as illustrated in FIGS. 1*h* through 1*a*. In this case, as illustrated in FIG. 1*g*, when the person's feet are detected by the foot rest pressure sensor the motor 23 is energized to drive the let rest down, adaptively moving with the person's feet down to the positions shown in FIGS. 1*f* and 1*e*. When the mattress 7 has been raised to a position above that shown in FIG. 1*d*, the motor 23 drives leg rest 12 fully down and the seat 10 to a level seating position.

It should be noted that the pressure sensing switch which is described subsequently is only one of a number of devices which can be used to detect and measure the position of a person's body on the wheelchair, and there is no intent to limit the equipment configuration to using that particular sensor. For example other electromechanical, photo-electric, fiber optic, or electrostatic or sensors may be used, or the rotation of the chair may be manually controlled, especially for transferring a person without feet.

Figure 2:
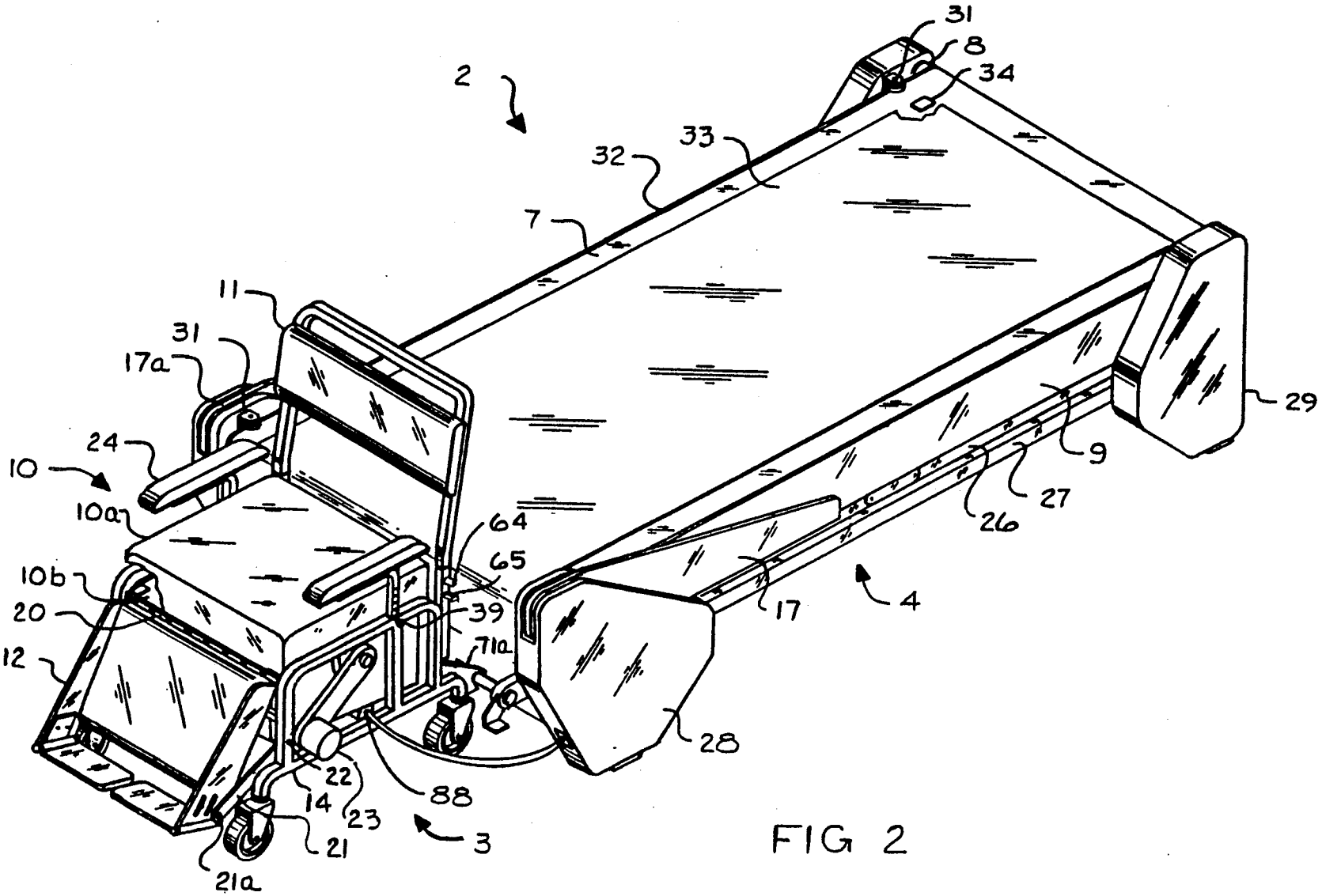
FIG. 2 is a perspective view of the invalid transfer arrangement showing the wheelchair latched to the bed.

FIG. 2 is a perspective view of the invalid transfer arrangement, showing wheelchair 3 latched to the bed. The bed 2 consists of a modified standard hospital-type bed 4, including an articulated frame 26, a support frame 27, and a special mattress 9 which includes a slippery cover sheet of nylon or similar material to provide a low friction surface over which a transport sheet can slide. At the foot and head ends of the bed, front and rear drive units 28 and 29, respectively, are mounted to the fixed frame 27. These units include front and rear rollers and their drives, which are described subsequently. The front drive unit also includes the mattress lift member 17 which is described subsequently. A transport sheet 7 having a low-friction bottom surface for sliding over the mattress cover extends over the mattress 9 between front and rear rollers in drive units 28 and 29. An idler roller 8, bolted or otherwise fastened to articulated frame 26, supports the transport sheet 7 at the head end of mattress 9. The front and rear drive units 28 and 29 include hem guides 31 with shaped grooves having wide sections through which the thickened hems 32 of the transport sheet 7, slide and narrow openings which capture the thickened hems through which the sheet slides. The thickened hems of the sheet are held at the sides of the bed by the hem guides which guide the transport sheet 7 in an orderly fashion onto the sheet-driving rollers in front and rear drive units 28 and 29. A bed sheet 33 is fastened to transport sheet 7 by sheet fasteners 34 at each corner. These fasteners may consist of strips of press-and-hold, pull-and-release material such as that available commercially under the trademark VELCRO, or other attachment methods may be used, in the form of snaps, zippers, buttons, hooks and eyes, clamps, or the like. The fastener locations may also be different —for example extending along one or more edges of sheet 33.

FIG. 2 shows the wheelchair 3 locked to bed 2 through a chair latch 71*a*. Electric drive motor 23 is coupled to the seat 10, through a connecting chain and sprockets, not shown, or it may be coupled to link 21 as shown subsequently. A solenoid 64 can be energized to unlatch the backrest II so that it can be lifted out, thereby opening the backrest switch 65, which provides backrest status information to the control system, described subsequently. The arm rests 24 can be adjusted or removed from the frame 14 by pulling out holding pins 39 on each side of the wheelchair. Electric power for actuating the motor 23 is carried to the wheelchair through cable and connector 88. The leg rest 12 is connected to frame 14 by links 21 through pivots 21*a* and 22, and by hinge 20 to seat 10. Seat 10 is comprised of seat cushion 10*a* removably fastened to seat base 10*b*.

Figure 2A:
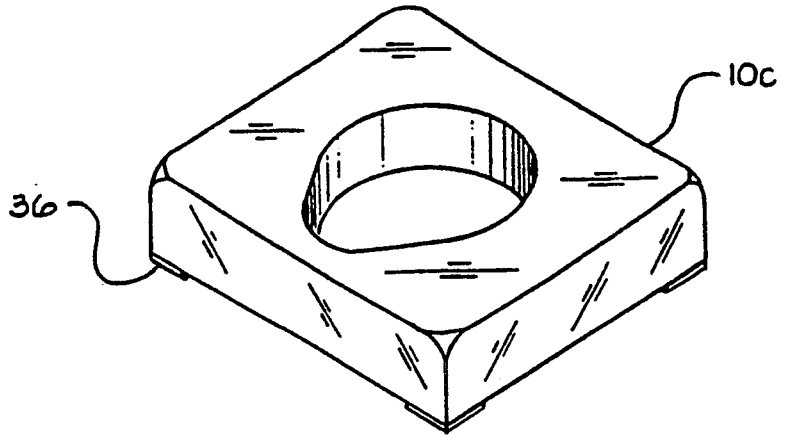
FIG. 2*a* is a perspective view of the commode seat.

FIG. 2*a* shows a commode seat 10*c* which can be removably fastened to seat base 10*b* for use over a toilet or with a chamber pot (not shown).

Figure 3:
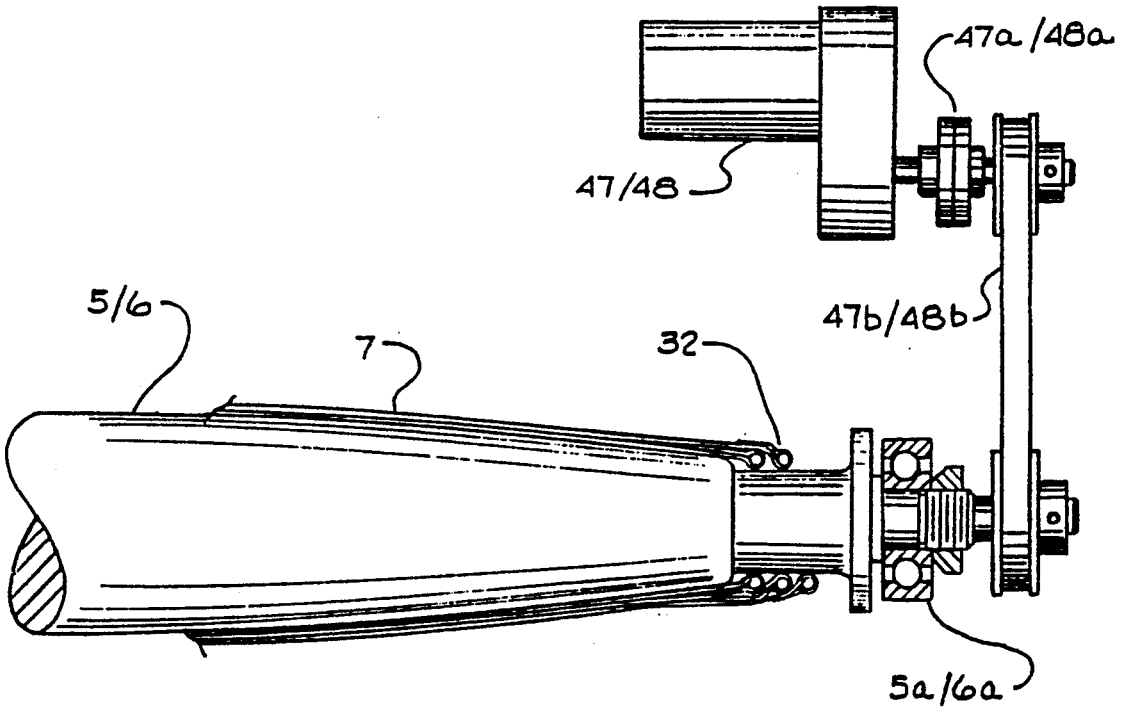
FIG. 3 is a partial front view of the sheet roller and drive motor.
Figure 7:
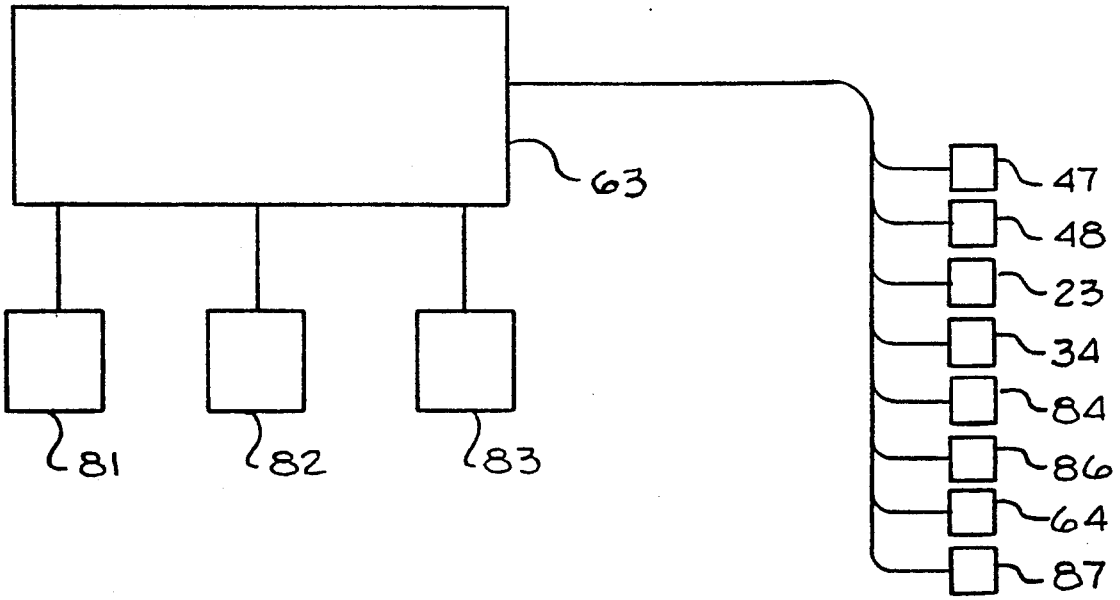
FIG. 7 is a schematic diagram showing the control system.

FIG. 3 is a partial front view of the front roller 5 rotating on bearings 5*a* in the front drive unit 28 and driven by front sheet drive 47 through optional front clutch 47*a* and belt 47*b*. The elevated rear end view BB in FIG. 7 is identical. Front and rear sheet drives 47 and 48, respectively. comprise conventional reversible a-c motors driving through speed reduction gear boxes. Alternatively, variable speed a-c or d-c motor drives may be used to accommodate special patient needs.

The front and rear rollers 5 and 6 are thickest in the middle and taper down to a small diameter near both ends to cause the transport sheet 7 and the thickened hem 32 to wind up in an orderly fashion in the end regions of the roller as shown in FIG. 3, and to concentrate the pulling force at the center of the transport sheet where the drag load from the patient is concentrated, thereby preventing the drag load from pulling the edges of the sheet in toward the center of the bed.

Figure 4A:
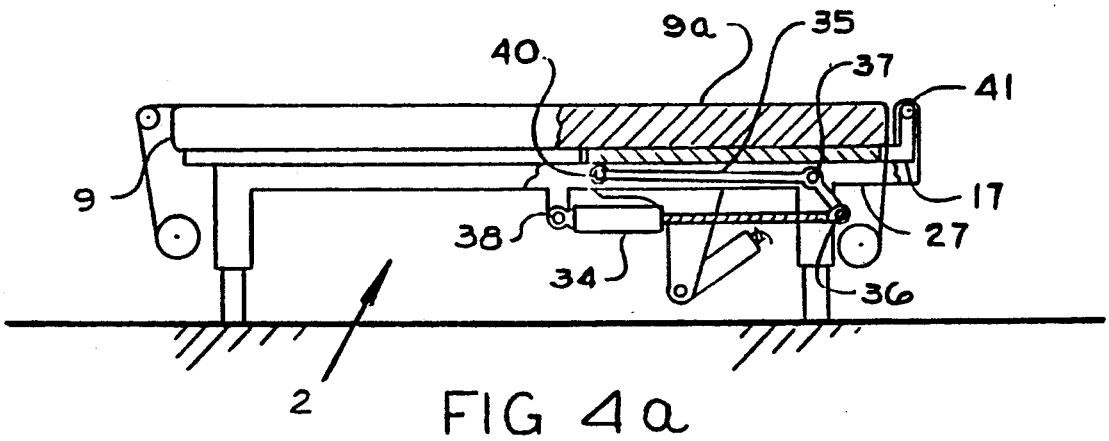
FIG. 4*a* is a side view of the bed showing the mattress lift in its lowered position.

FIG. 4*a* is a partial cross-sectional view of the bed 2 showing the mechanism for lifting the mattress 9. The cross-sectioned portion 9*a* of the mattress 9, which extends to the foot end of the bed, is supported by the mattress lift member 17 which is connected to the support frame 27 through pivots 41 at each side of the bed. A linear actuator 34, which may be located under the middle of the bed, is connected, at one end, through the pivot 38 to the support frame 27 and, at its other end, is rotatably connected to a rod 36. The rod 36 connects to ends of links 35 which are connected through pivots 37 to the support frame 27 near each side of the bed. Rollers 40 at the other ends of links 35 support the mattress lift member 17.

Figure 4B:
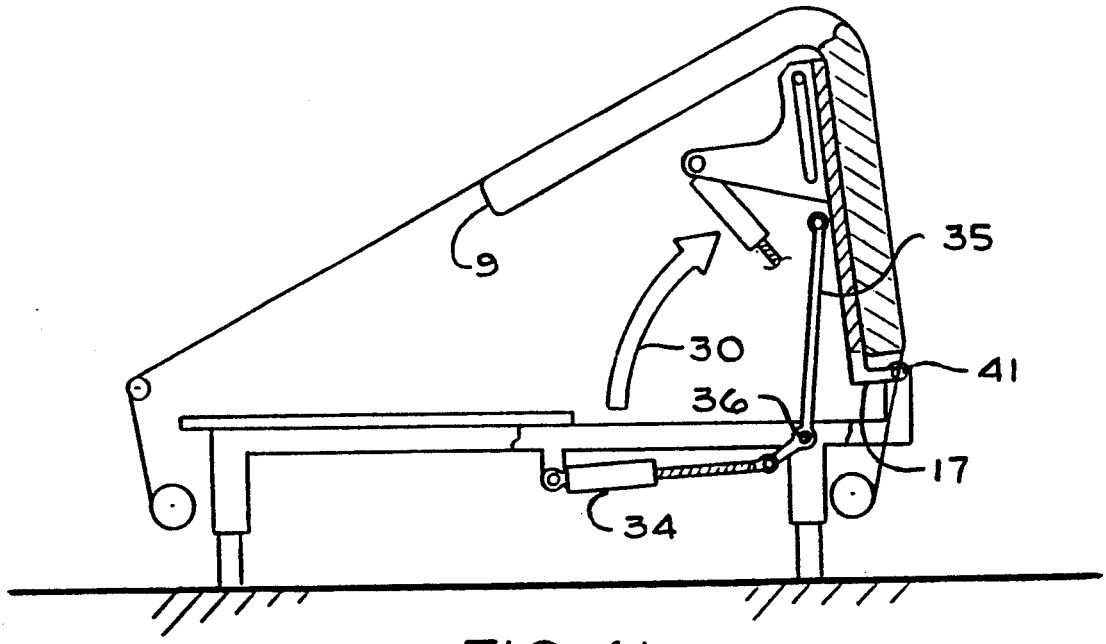
FIG. 4*b* is a side view showing the mattress lift fully raised.

FIG. 4*b* shows that the mattress lift member 17 and the mattress 9 rotate about pivots 41 as they are lifted in the direction of arrow 30 by the links 35 pulled by the actuator 34 through the rod 36.

Figure 5:
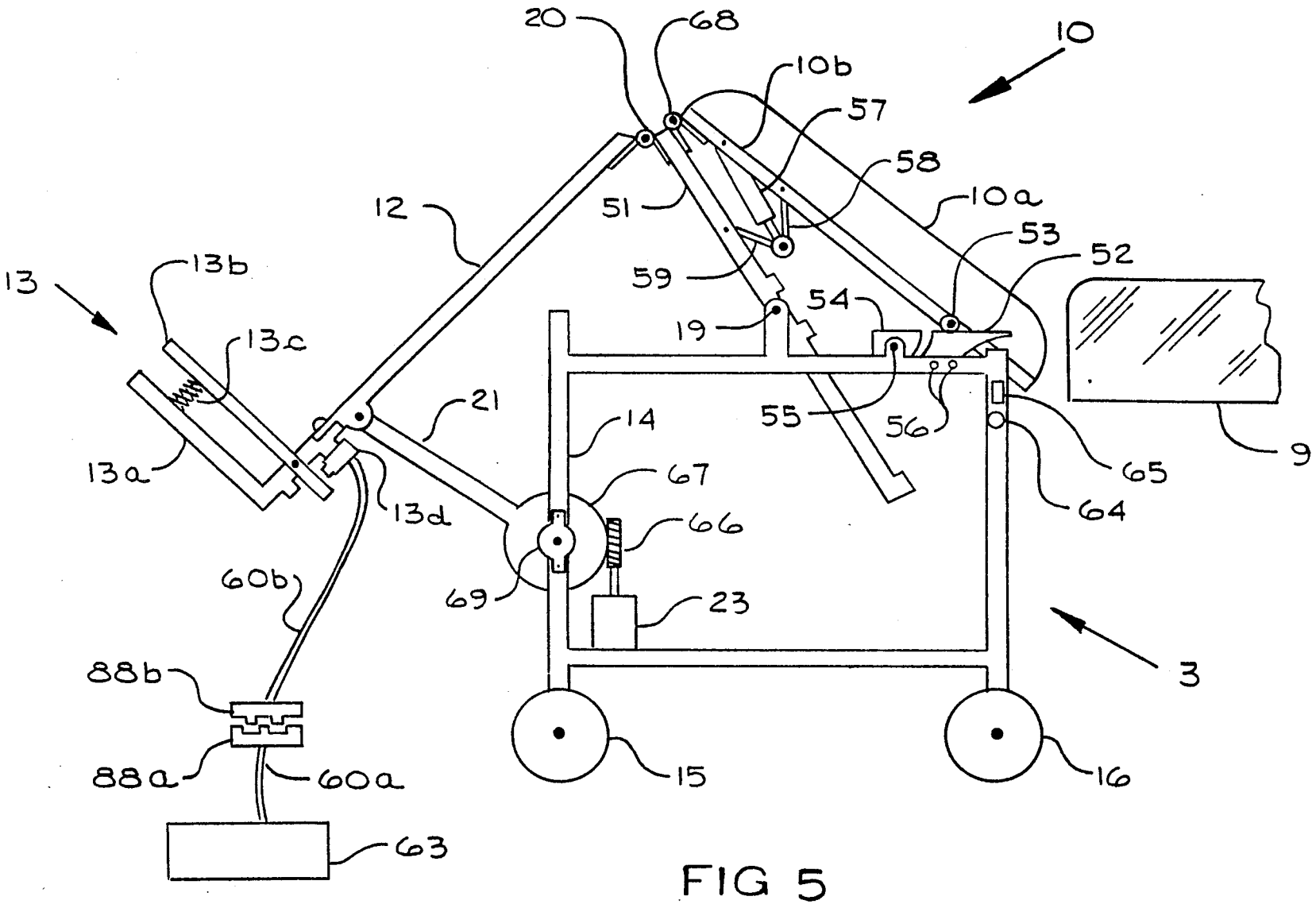
FIG. 5 is a side view of the wheelchair showing the foot rest switch and the arrangement for moving the seat.

FIG. 5 is a side view of the preferred configuration of the wheelchair 3 with the backrest removed and with the wheelchair positioned adjacent to the foot end of the mattress 9 which is shown in partial view. This configuration provides improved support of the patient as the transfer progresses as shown in FIGS. 1*e* to 1*f*. When the seat rotates from the position shown in FIG. 1*e* a gap develops between the end of the mattress and the chair seat 10, and this gap is uncomfortable for some patients when they are transferred from wheelchair to bed. In the arrangement shown in FIG. 5 this problem is overcome by delaying the rotation of the seat 10 until the patient's rump has been moved onto the mattress, and then allowing the seat to drop down to the rotating support frame 51 as described below.

In FIG. 5 the wheelchair 3 has wheels 15 and wheels 16 supporting a frame 14, to which a leg rest 12 is pivotally connected through a rotatable link 21 and a rotatable support frame 51, which comprise a four bar linkage. A reversible motor 23 is coupled through a worm gear 66 which engages a sector gear 67 on link 21 for lowering the leg rest 12 to a seating position in front of the wheelchair or raising it to a substantially horizontal position above the top of the wheelchair frame 14. A leg rest position sensor, 69, which may comprise a potentiometer or cam-driven switches, is mounted on the frame 14 and coupled to the sector gear 67. The seat cushion 10*a* is removably attached to the seat base 10*b* which is attached through a hinge 68 to the support frame 51. Rollers 53 are rotatably attached to the seat base 10*b* on each side. When the leg rest 12 is fully lowered to its seating position in front of the wheelchair the support frame 51 is substantially horizontal with the seat base 10*b* resting on it.

On each side of the wheelchair fixed roller supports 52 are attached by bolts 56 to the inside of the frame 14, and pivoted roller supports 54 are attached through pivots 55, and are supported so that they are rotatable up, but not down. When the leg rest 12 is raised the seat 10 rotates with the support frame 51 until the seat rollers reach the pivoted roller supports 54. As the leg rest continues to rise, the seat 10 rolls back toward the mattress 9 across and off the ends of roller supports 52 and then, rotating about the hinge 68, drops down to the rotating support frame 51. It is held against the support frame 8 by the gas spring 57 which is pivotally connected at one end to the seat frame 10*b* and at the other end through the links 59 and 58 to the rotating frame 51 and the seat base 10*b* respectively. The gas spring has a dash-pot damping action to slow the speed of the seat motion. Springs of this type are widely available commercially and are well known in the art.

In FIG. 5, as the leg rest 12 moves up to above the wheelchair frame 14, support frame 51 and the seat 10 rotate to an inverted position under the leg rest. When the leg rest 12 is driven down, the seat remains pressed to the support frame 51 and rotates back to its substantially horizontal seating position. During this motion the seat rollers 53 strike the bottoms of the pivoted roller supports 54, which pivot up to allow passage of the seat rollers. Experience has shown that in transferring a patient from the bed to the chair the simple rotation of the chair seat provides adequate and comfortable support for the patient.

A foot rest 13 comprises a foot support 13*a*, which is fastened to the leg rest 12, a foot sensor plate 13*b* which is pivotably attached to the foot support 13*a* and is held away from it by a compression spring 13*c*, and a foot-pressure switch 13*d* which is mounted on the footrest with its actuator resting on the foot sensor plate 13*a* so that the switch is actuated when the foot pressure plate is pushed and deflected against the spring 13*c*.

The system controller 63 is connected through a cable 60 and electrical connectors 88*a* and 88*b* to the foot pressure switch 13*d*. The controller is similarly connected to the backrest switch 65 the leg rest position sensor 69 the rive motor 23 and the backrest unlock solenoid 64, but for clarity the additional connecting cables to the wheelchair are not shown.

Alternatively, various other signal transmission methods can be used in place of electrical conductors from the several switches and sensor to the system controller. Suitable methods include radio, ultrasonic, optical, capacitive or inductive coupling. Mechanical links to the bed may be used to drive the leg rest and unlatch the back rest.

A foot pressure signal is used by the controller to regulate the transfer operation in both directions. As a safety precaution unless a footrest pressure signal is received the controller does not respond to an initial command to transfer a person from the wheelchair to the bed. During a transfer to the wheelchair when a person is being moved by the conveyor sheet onto the leg rest, a foot pressure signal to the controller causes the foot rest to move adaptively away from the person's feet. Since the leg rest moves faster than the transfer sheet, the leg rest starts and stops, moving in steps. The controller provides a small response delay to reduce the number of steps. When the person is being moved onto the bed, initially the person is pulled by the conveyor sheet and pushed by the rotating leg rest and foot rest. When the person is far enough on the bed for the conveyor sheet alone to pull him onto the bed the controller stops the motion of the leg rest whenever a foot pressure signal is received, to prevent excessive pushing.

Figure 6:
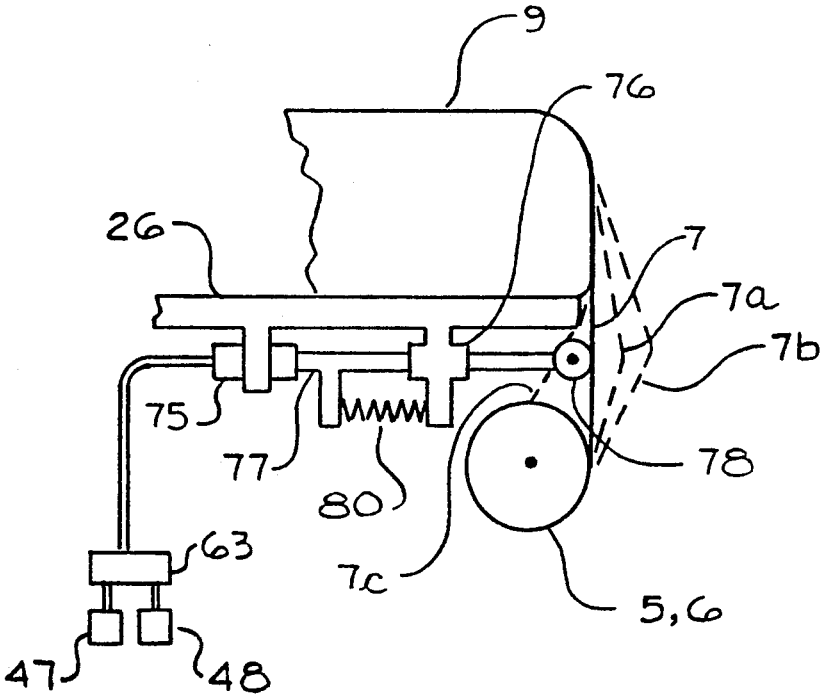
FIG. 6 is a partial side view of the mattress and shows an arrangement for measuring sheet tension.

FIG. 6 includes a partial side view of the mattress 9, the articulated bed frame 26, and the conveyor sheet 7 and shows an arrangement for measuring sheet tension and for controlling the sheet drive motors, 47 and 48. The sheet 7 is fastened to and wound on the front sheet roller 5 and the rear sheet roller 6. The sheet tension measurement configuration is the same for both sheet rollers. A linear position sensor 75 which may be a linear potentiometer is mounted on the frame 26. The actuating rod 77 of the sensor passes through and is slidably supported by a sleeve bearing 76. At the end of the rod 77 is a roller 78 which is pushed against the sheet 7 by action of the tension spring 80 which extends between the rod and the frame 26. When the sheet 7 is taut, the potentiometer actuator shaft is positioned as shown. When the sheet is moderately taut the sheet is pushed out to the path *7a*, and when the sheet is slack it is pushed out further to path *7b* and the output signal from the linear sensor changes accordingly. The sensor is connected to the controller 63 which then sends appropriate power to the sheet roller drive motor to correct the sheet tension as required for proper operation. For example, if the sheet 7 is being wound on the roller at the foot end of the bed and the linear sensor at the head end of the bed indicates a taut sheet, the controller will cause the head-end motor to unwind the sheet 7 until the sensor indicates that the sheet is slack. If the sheet has been completely unwound from a roller 5 or 6 the sheet path will be *7c*. This limit condition will be recognized by the logic built into the controller which will take immediate action to stop or reverse any motors, which are causing this condition.

Other sensors, such as cam-actuated switches or an appropriately coupled rotary potentiometer can be used in place of a linear potentiometer for sensor 75.

FIG. 7 is a schematic diagram showing the control system. The controller 63 receives, input signals from a number of sensors 81 and command signals from manual controls 82 It contains logic and output control circuitry well known in the art which provide outputs to the display indicators 83 and power to the various motors and linear actuator and solenoids in the transfer system, and thereby regulates the manual and automatic operation of the transfer system. The motors controlled include the sheet drive motors, 47 and 48, the chair motor 23, the linear actuator 34 for raising the mattress, the bed height motor 84 and the head elevation motor 86. The solenoids controlled include a solenoid 64 for unlocking the back rest so it can be removed from the back of the chair and a solenoid 87 for unlocking the latch release mechanism to enable release of the wheelchair from the bed. The sensors 81 include but are not limited to sensors for measuring the elevation of the mattress, the bed height, the elevation of the head section of the bed, and the position of the conveyor sheet, the leg rest position sensor, the foot pressure switch or other foot position sensor, the back rest switch, a head board pressure switch which is actuated when the person's head or a pillow presses against the head board of the bed, a weight sensor to detect the presence of a person lying on the bed, a wheelchair-latched switch which is actuated when the wheelchair is securely latched to the bed and a wheelchair-locked switch which is actuated when the latch release mechanism is locked to prevent the wheelchair from being released from the bed when such release could cause injury to a person or damage to the transfer system. The controls 82 may include: a hand-held bed-control pendant normally used by the person in the bed with push button or rocker switches to adjust bed height, head elevation, leg elevation, and to move the conveyor sheet toward the head and or foot end of the bed; a hand-held transfer pendent, to control transfer operation with two switches, one to transfer a person from the wheelchair to the bed, as shown in FIGS. 1*a* through 1*h*, and the other to transfer the person from bed to the wheelchair; a control panel which may contain a selector switch for selecting the mode of operation, including OFF, bed pendant control, transfer pendant control, and manual control whereby the individual transfer system components such as the wheelchair leg rest 22, the mattress lift, and the conveyor sheet can be controlled separately, using switches on the control panel. The displays, 83 include status lights which indicate the mode of operation which has been selected and operating assistance lights to indicate what action is needed by the operator or to indicate an equipment problem. The displays 83 may also include audio alert signals, a liquid crystal or other type of alpha-numeric display, or voice messages.

Figure 8:
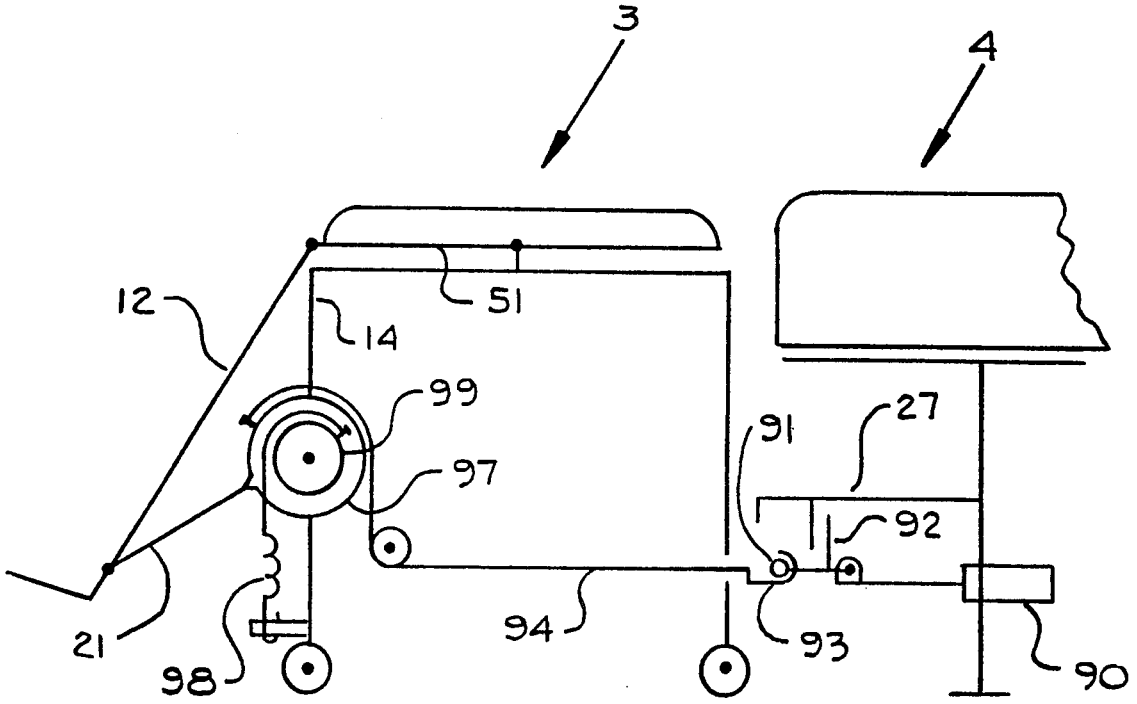
FIG. 8 is a schematic drawing showing an alternate arrangement for moving the wheelchair leg rest.

FIG. 8 shows schematically in a side view an alternate arrangement for latching a wheelchair 3 to the end of a bed 4 and positioning the leg rest 12 by means of an electrically driven linear actuator 90 mounted on the bed support frame 27. A draw bar 91 extends along the end of the bed and is pivotably connected through a link 92 to a linear actuator 90 which contains an electric motor. The draw bar is shown positioned within the latch hook 93 which is connected through a cable 94 to the link 21, the cable being wound and fastened on a drum 97 which is attached to the link 21 and pivoted on the wheelchair frame 14. The leg rest 12, is pivotably connected through the link 21 and the support frame 51 to the wheelchair frame. A tension spring 98, connected between the wheelchair frame 14 and a drum 99 on link 21, acts to pull the link 21 down thereby holding the leg rest in its seating position, as shown. When the linear actuator pulls the draw bar 93 and the hook 93 toward the bed 4 the wheelchair 3 is pulled and effectively latched to the bed when the wheelchair frame 14 is stopped by and firmly held against the bed frame 27.

Further motion of the linear actuator 90 overpowers the spring 98, rotates the drum 97 and the link 21, and thereby moves the leg-rest 12 up to its transfer position.

When the actuator moves the draw bar 91 away from the bed, the spring 98 pulls the leg rest down to its seating position. Further such motion of the actuator moves the draw bar further toward the wheelchair until the link 92 moves against the bed frame 27, causing the link 92 to pivot up and to move the draw bar 91 above and free of the latch hook 93. The wheelchair 3 can then be moved away from the bed 4. The process can be reversed to latch the wheelchair to the bed.

It is clear that alternatively the hook 93 in FIG. 8 may be shaped so that it can be pushed as well as pulled by the linear actuator 90, or that a different removable fastener may be used, to connect the actuator to a rack and pinion on the chair with the pinion coupled to the link 21 for reversibly driving the leg rest without the need for the spring 98.

I claim:

1. An invalid transfer arrangement comprising: a bed with a foot end and a head end; said bed having a mattress, a roller at said head end, a roller at said foot end, and a transport sheet extending across said mattress and fastened to each roller, said sheet being partially rolled on each roller; a wheelchair positioned at said foot end of the bed; said wheelchair having a frame, a seat, a removable back rest and a leg rest; said leg rest being movable from a seating position sloping down from said seat to a substantially level transfer position above said seat; a spring connected to said frame and said leg rest for forcing said leg rest down to said seating position; hook means positioned at the back of said wheelchair; said hook means being coupled to said leg rest, said leg rest being movable from said seating position to said transfer position by pulling said hook means; a bar adjacent and parallel to said foot end of said bed; a linear actuator on said bed and pivotably connected to said bar, said bar being extendable from said bed by extending said actuator a predetermined distance, said bar being raisable by further extension of said actuator; said actuator being retractable for lowering said bar to capture said hook means, for pulling said wheelchair firmly against said bed, and for acting against said spring and raising said leg rest to said transfer position; said actuator being extendable for lowering said leg rest and moving said bar out, up and free of said hook means.

2. An invalid transfer arrangement comprising: a bed with a foot end and a head end; said bed having a mattress, a roller at said head end, a roller at said foot end, and a transport sheet extending across said mattress and fastened to each said roller, said sheet being partially rolled on each said roller; a wheelchair positioned at said foot end of the bed; said wheelchair having a seat, a frame, a removable back rest, and a leg rest; said seat being pivotally connected to said frame and said leg rest; said leg rest being movable from a seating position sloping down from said seat to a substantially level transfer position above said seat; said seat rotating pivotally when said leg rest moves to said transfer position; a linear actuator on said bed; connecting means for removably connecting said actuator to said wheelchair; and coupling means between said leg rest and said actuator for moving said leg rest between said seating position and said transfer position by said actuator without lifting said wheelchair.

3. An invalid transfer arrangement comprising: a bed; a wheelchair positioned at a foot end of said bed; said wheelchair having a seat, a removable back, a movable leg rest, and hook mean coupled to said leg rest; means on said bed for engaging and pulling said hook means to raise said leg rest and move said leg rest over said seat for transporting a person from said wheelchair onto said bed.

4. An invalid transfer arrangement comprising: a bed; a wheelchair positioned at a foot end of said bed; said wheelchair having a seat pivotally connected to said wheelchair; bed attaching means connected to said seat; said bed having wheelchair connecting means for connecting to said bed attaching means; a source of mechanical power on said bed for pulling said wheelchair connecting means when connected to said bed attaching means to pull said wheelchair against said bed and pivot said seat for moving a person from a sitting position on said wheelchair to a lying position on said bed.

5. An invalid transfer arrangement comprising a bed with a foot and a head end; said bed having a mattress, a roller at the head end, a roller at the foot end, and a transport sheet extending across said mattress and partially rolled onto each roller; a chair positioned at the foot end of said bed; said chair having a seat and a leg rest; said leg rest being movable from a seating position sloping down from said seat to a substantially level transfer position above said seat; connection means coupled to said leg rest so that by pulling on said connection means said leg rest is movable from said seating position to said transfer position; said bed having a motor for pulling said connection means and raising said leg rest to said transfer position.

6. A method for moving a person from a seated position on a chair to a bed, comprising the steps of: providing a chair with a seat pivotally connected to said chair; providing bed attaching means connected to said seat in said chair; attaching said chair to a bed with said bed attaching means; and pulling or pushing said bed attaching means for pivoting said seat and moving the person from said chair to said bed.

7. A method of moving a person from a seated position on a chair to a bed, comprising the steps of: providing a chair with a seat pivotally connected to said chair; providing seat pivoting means connected to said seat in said chair; and pulling or pushing said seat pivoting means for pivoting said seat and moving the person from said chair to said bed.

8. An invalid transfer arrangement comprising: a bed with a foot end and a head end; said bed having a mattress, a roller at said head end, a roller at said foot end, and a transport sheet extending across said mattress and fastened to each said roller, said sheet being partially rolled on each said roller; a wheelchair positioned at said foot end of the bed; said wheelchair having a seat, a frame, a removable back rest, and a leg rest; said seat being pivotally connected to said frame and said leg rest; said leg rest being movable from a seating position sloping down from said seat to a substantially level transfer position above said seat; said seat rotating pivotally when said leg rest moves to said transfer position; a linear actuator on said bed; connecting means for removably connecting said actuator to said wheelchair; and coupling means between said leg rest and said actuator for moving said leg rest between said seating position and said transfer position by said actuator without lifting said wheelchair; said coupling means having a driving member connected to said leg rest and said seat; a flexible cable wound around said driving member and fastened to one end of said driving member, said flexible cable being removably connected to said actuator, said actuator having actuating motion for rotating said driving member and moving said leg rest and said seat.

* * * * *